US005941039A

United States Patent [19]

Law

[11] Patent Number: 5,941,039

[45] Date of Patent: Aug. 24, 1999

[54] ROOF TILE

[75] Inventor: Frazer William Timothy Law, London, United Kingdom

[73] Assignee: Redland Technologies, Limited, United Kingdom

[21] Appl. No.: 08/640,763

[22] PCT Filed: Nov. 8, 1993

[86] PCT No.: PCT/EP93/03124

§ 371 Date: Jun. 28, 1996

§ 102(e) Date: Jun. 28, 1996

[87] PCT Pub. No.: WO95/13441

PCT Pub. Date: May 18, 1995

[51] Int. Cl.[6] ..... F04D 1/04

[52] U.S. Cl. ..... 52/540; 52/533; 52/536; 52/539

[58] Field of Search ..... 52/540, 541, 535, 52/536, 533, 539, 538

[56] References Cited

U.S. PATENT DOCUMENTS

| | | | |
|---|---|---|---|
| 651,873 | 6/1900 | Ludowici | 52/536 X |
| 746,747 | 12/1903 | Schlachter | 52/533 |
| 5,048,255 | 9/1991 | Gonzales | 52/533 |

FOREIGN PATENT DOCUMENTS

| | | | |
|---|---|---|---|
| 678706 | 4/1930 | France . | |
| 766840 | 7/1934 | France . | |
| 1087801 | 3/1955 | France . | |
| 1097530 | 7/1955 | France . | |
| 16814 | 1/1882 | Germany . | |
| 2204151 | 8/1973 | Germany | 52/536 |
| 3030819A1 | 2/1982 | Germany . | |
| 3708281 | 9/1988 | Germany | 52/536 |
| 6429 | 3/1893 | Switzerland | 52/536 |
| 194695 | 12/1937 | Switzerland . | |

*Primary Examiner*—Carl D. Friedman
*Assistant Examiner*—Winnie S. Yip
*Attorney, Agent, or Firm*—Rothwell, Figg, Ernst & Kurz, P.C.

[57] ABSTRACT

The present invention is directed to a concrete roof tile having a front edge surface, which is that surface of the tile across the width of the tile and which faces downwardly when in use on a roof. The front edge surface has a progressively greater depth as between a relatively thin profiled central portion and thicker profiled side portions. In use, the horizontal rows of the roof tiles are laid in half-bond relationship with adjacent horizontal rows to give a pleasing appearance in which the combined overlapped thicknesses of the tiles in one such row of tiles and the tiles of adjacent rows of tiles above and/or below at overlapped headlap and tail portions are the same or substantially the same.

30 Claims, 4 Drawing Sheets

ROOF TILE

This is a national stage application filed under 35 U.S.C. 371 of PCT/EP93/03124 filed Nov. 8, 1998.

BACKGROUND OF THE INVENTION

This invention is concerned with improvements in or relating to a roof tile and particularly this invention is concerned with improvements in or relating to contoured interlocking roof tiles.

By "contoured" where used herein it is meant a roof tile having a profiled upper surface, for example, a double Roman, a bold roll or similar tile. Such a tile generally comprises profiled side portions on each side of a profiled central portion with the side portions being provided with upwardly or downwardly facing channels respectively for facilitating, in use, the interlocking of each tile with sideways adjacent tiles on a roof.

It is well known that the front edge thickness of most interlocking concrete roof tiles is governed by the minimum thickness required for the interlock at the longitudinal edges of the tiles. The thickness of the interlock portion of the tile is maintained across the tile so that the depth of a front edge surface thereof, i.e. that surface facing downwardly of a roof, in use, is constant or substantially so. Thus, when one tile is laid upon another in use, no gaps are evident between the overlapped head and tail lap portions of the tile whether the tiles are laid in full bond or broken bond relationship across the roof. When the roof tiles are placed on a roof, the edge surfaces of the tiles extend at a right angle to the slope of the roof. Horizontal rows of the tiles overlap adjacent rows of the tiles leaving the front edge surface with respect to the position of a tile on the roof visible to a person looking up at the roof. This front edge surface is thus considered to face downwardly of a roof in use.

Such design of roof tile dictates that an unnecessary proportion of the tile weight is evident in the thick front edge portion of the tile which thick front edge portion adds little if any structural value to the tile and has a principal aim of closing any gaps which might otherwise be evident between overlapped tail and headlap portions of tiles laid on a roof.

The present invention seeks to mitigate or overcome the shortcomings of known tiles and involves a roof tile with a profiled upper surface and a front edge surface, which front edge surface extends across the width of the tile and faces downwardly of a roof in use, wherein the front edge surface is of progressively greater depth as between a relatively thin profiled central portion and thicker profiled side portions thereof.

Prior art document FR-A-1097530 describes tiles having a front edge surface which is progressively greater depth as between a relatively thin profiled central portion and thicker profiled side portions. However, this prior art document describes tiles which can only be laid in full bond relationship. Prior art document DE-C-16814 describes tiles with a thickness in cross-section which varies across their width; however, these tiles do not have a profiled upper surface. Neither of these prior art documents disclose the features of the present invention.

SUMMARY OF THE INVENTION

The present invention therefore provides a tile comprising a raised central portion, a raised interlocking side portion at each side of said tile and a valley portion between each side portion and said central portion, said tile having a front edge surface which extends across the width of said tile and faces downwardly of a roof in use, characterised in that said front edge surface is of a depth which becomes progressively greater between a relatively thin section coincident with said central portion, and relatively thicker sections adjacent to said interlocking side portions.

Preferably, the invention provides a tile wherein the front edge surface of the tile varies in depth across the width of the tile as between a relatively thin section coincident with said central portion, deeper sections coincident with said valley portions and sections of intermediate depth coincident with said interlocking side portions.

Also preferably, the invention provides a tile wherein, in use, the depth of the front edge surface in the area of the valley portions is less than the combined thickness of the interlocked side portions of mutually sideways adjacent tiles in use.

Conveniently the depth of the front edge surface in the area of the valley porions thereof approximates to one-half the combined depths of the front edge surface at the relatively thin section coincident with the central portion and the sections of intermediate depth coincident with the interlocked side portions of mutually sideways adjacent tiles in use.

Preferably the central portion is relatively thin as aforesaid for at least one-third of the length of the tile and more especially the central portion is relatively thin as aforesaid for the full length of the tile.

The present invention also conveniently provides a tile wherein the raised central portion thereof comprises an upper profile generated along the length thereof wherein an apex of said upper profile lies below a corresponding apex of a similar profile generated by the interlocked side portions of mutually sideways adjacent tiles in use.

Conveniently tiles according to the present invention, as set out above, may comprise a bold roll or a double Roman profile of roof tile.

The present invention still further provides a roof covered with roof tiles according to any one of the last seven preceding paragraphs wherein, in use, each horizontal row of tiles is laid in half-bond relationship with adjacent horizontal rows of such tiles and wherein the combined overlapped thicknesses of the tiles in one such row of tiles and the tiles of adjacent rows of tiles thereabove and/or therebelow at overlapped headlap and tail portions thereof are the same or substantially so.

Conveniently the visual appearance of the roof is one in which a constant thickness is evident at the valley portions of the tiles of each column of tiles on the roof whereas the roll portions thereof have a thick-thin, thick-thin appearance both in sideways adjacent columns of such tiles and in each individual column thereof.

BRIEF DESCRIPTION OF THE FIGURES

There now follows by way of example a detailed description of one embodiment provided by the invention, which description is to be read with reference to the accompanying drawings in which.

DETAILED DESCRIPTION OF THE INVENTION

The front edge thicknesses of conventional concrete roofing tiles result from having relatively thick, i.e. deep, sidelock portions the depth of which is maintained across the front edge portion of a tile to prevent gapping as between superimposed tiles on a roof. Prudent reduction of the front edge thicknesses of a tile provides a lighter product with consequent savings of cement, aggregate and pigment utilised for the composition from which the tile is manufactured.

Figure 1:
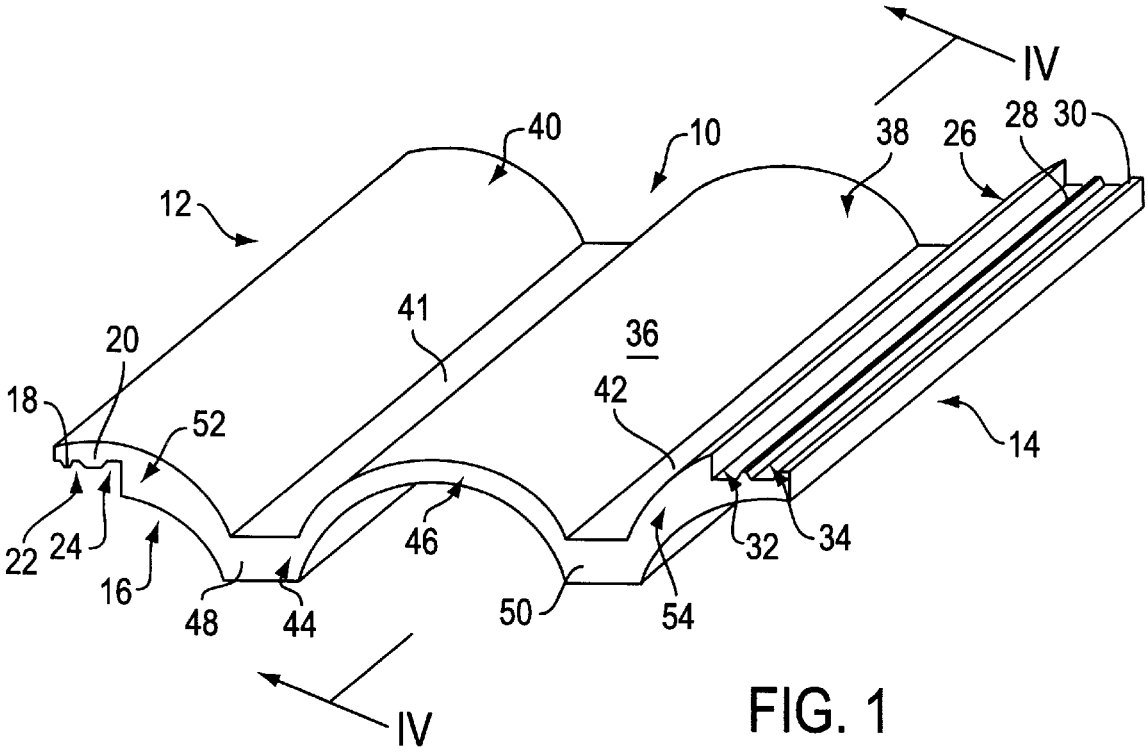
FIG. 1 is an upper perspective view of a roof tile provided by the invention.

The present invention provides an interlocking contoured roof tile 10, i.e. a "bold roll" type of tile, see FIG. 1.

The tile 10 is generally rectangular in plan and comprises left and right hand profiled interlocking side portions 12 and 14 respectively.

Figure 2:
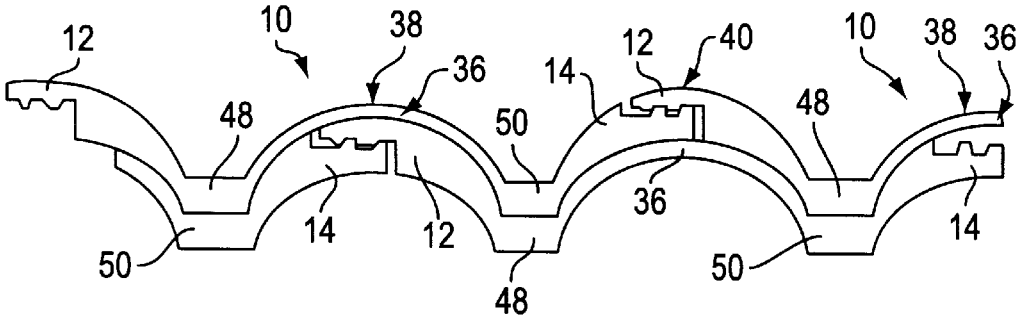
FIG. 2 is an end view of two layers of tiles as seen in the longitudinal plane of the tiles; and, FIG. 3 is an upper perspective view of a plurality of tiles in use on a roof.

The portions 12 is provided on an underside 16 thereof, see FIGS. 1 and 2, with longitudinally extending ribs 18 and 20 and channels 22 and 24 while the portion 14 is provided on an upperside 26 thereof with complementary ribs 28 and 30 and channels 32 and 34. The ribs and channels enable the mutual interlock of like tiles on a roof in use.

The tile 10 also comprises a profiled central portion 36 an apex 38 of which lies substantially below a corresponding apex 40 of the portion 12, see especially FIG. 2.

Figure 3:
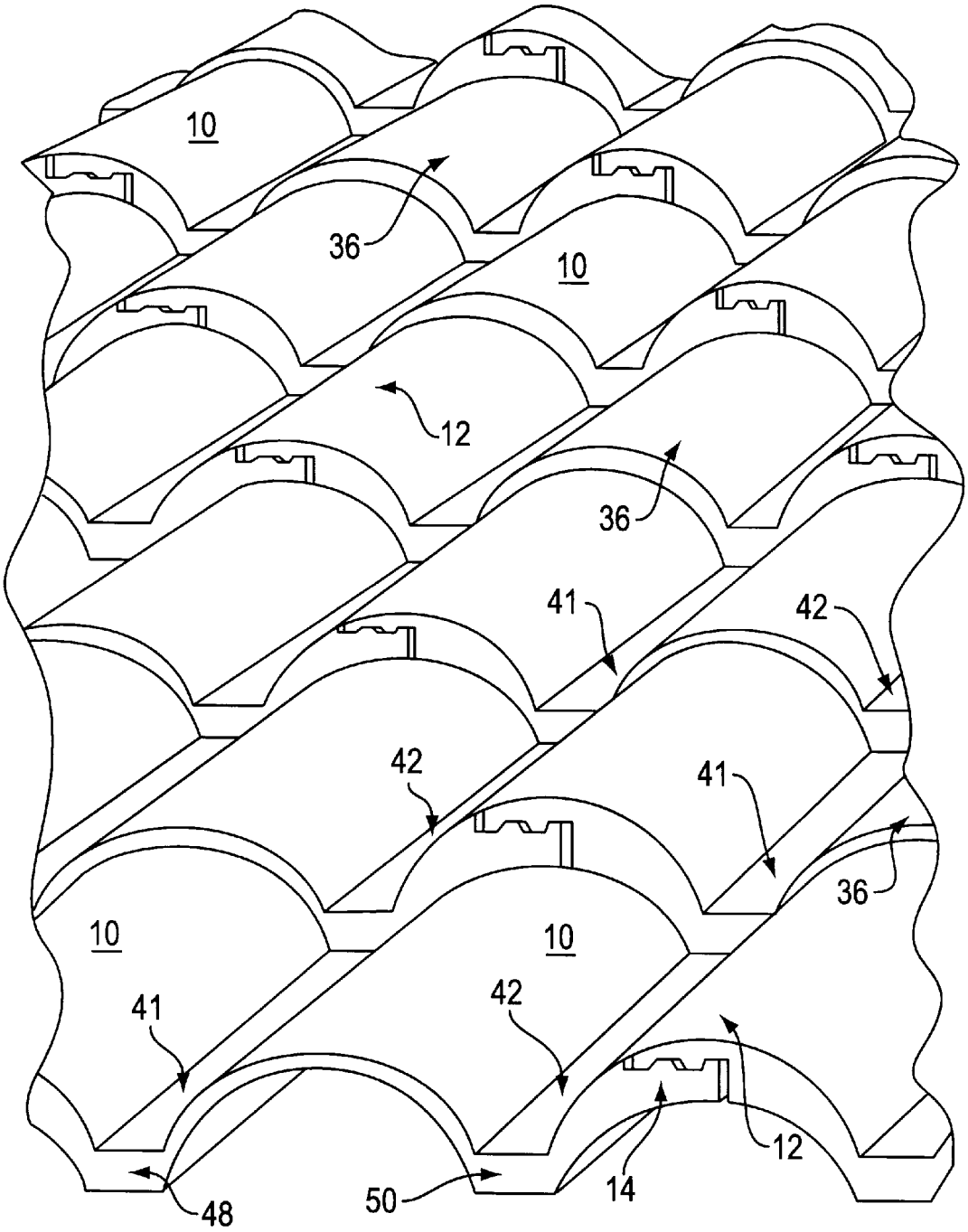
Figure 4:
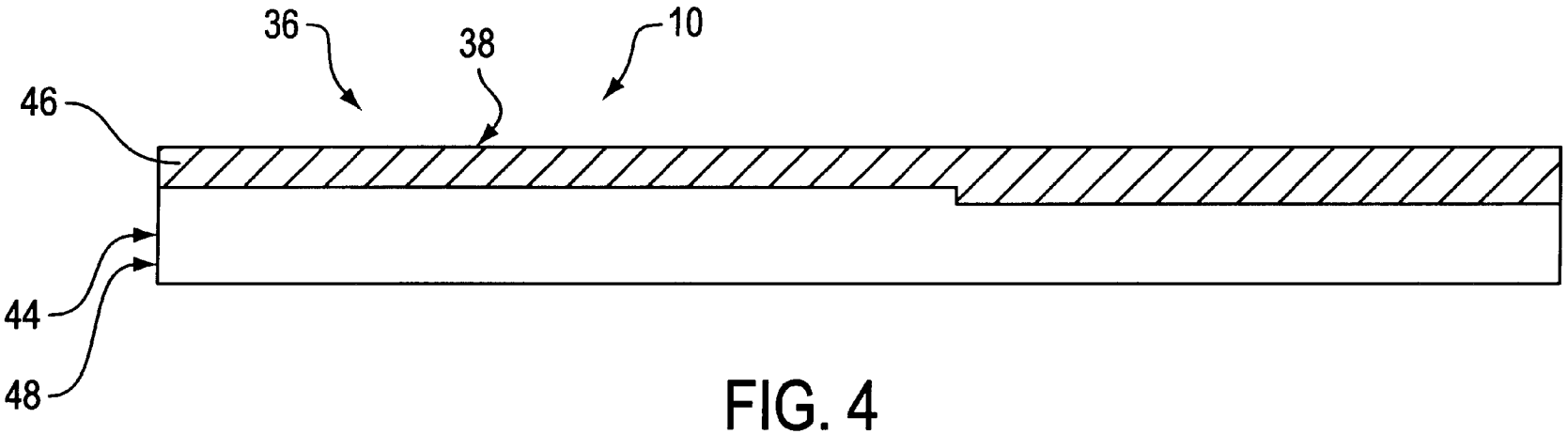
FIG. 4 is a cross-sectional side view of a tile which is taken generally along the line IV—IV shown in FIG. 1.

Between the profiled interlocking side portions 12 and 14 and the profiled central portion 36 are respective valley portions 41 and 42, see FIGS. 1, 2 and 3.

The tile 10 further comprises a front edge surface 44 which varies in depth across the width of the tile as between a relatively thin section portion 46 coincident with the central portion 36, deeper sections 48 and 50 coincident with said valley portions 41 and 42 and side face portions 52 and 54 of intermediate depth adjacent to said interlocking side portions 12 and 14 respectively.

The depth of the portion 46 reflects the thin section portion 36 which may be relatively thin for all of its length along the tile 10 or for a proportion of such length, say one-third thereof.

The depths of the sections 48 and 50 are such that each is one-half the depth-of a thin section portion 46 plus the combined depth of interlocked side portions 12 and 14 of a tile, see FIG. 2, where it is evident that in use the depth of two superimposed valley portions 41 and 42 is equal, or substantially so, to the combined depth of a thin section portion 46 and the interlock side portions 12 and 14.

Figure 5:
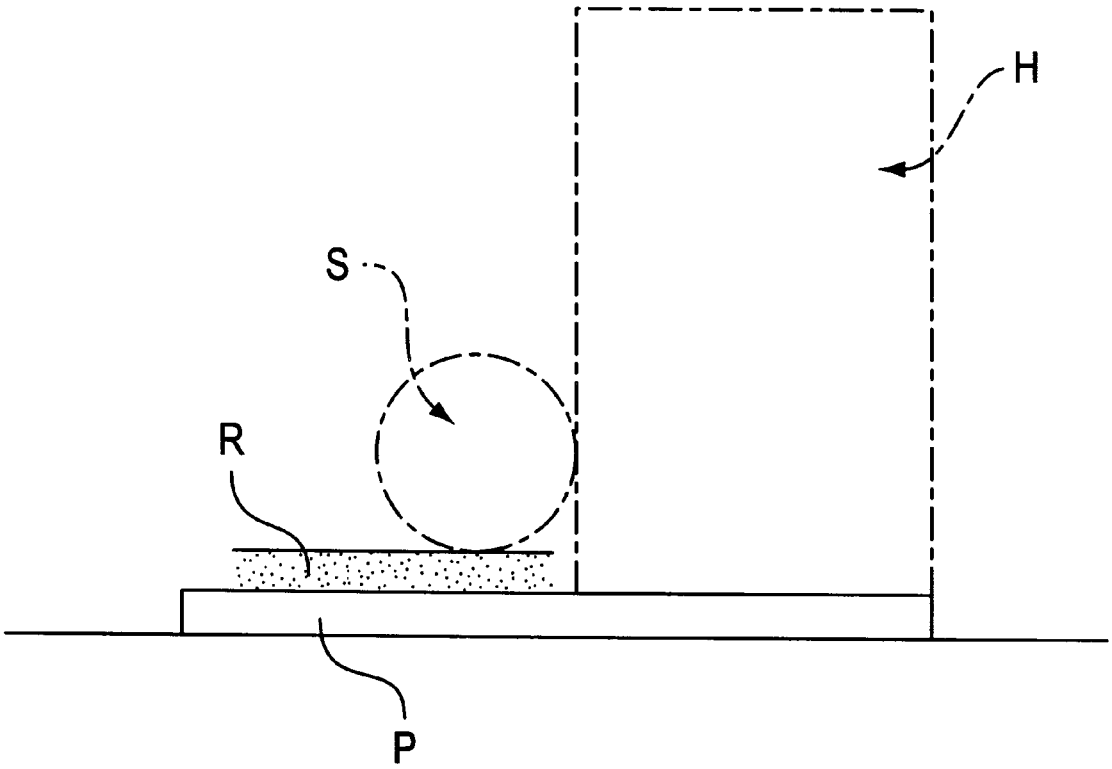
FIG. 5 is a schematic diagram showing mortar in a hopper passed beneath a shaping roller and slipper emerging as a ribbon of tile mortar.

The tiles 10 of the present invention may be formed by the well established concrete roof tile processing route wherein tile mortar provided to a hopper (shown schematically in FIG. 5 at H) is constrained to pass under a shaping roller and slipper (shown schematically in FIG. 5 at S) to emerge as a ribbon of tile mortar (shown schematically in FIG. 5 at R) on a series of identical tile pallets (shown schematically in FIG. 5 at P) with the tile shape and thickness being dictated by gaps provided between the upper surfaces of the pallets and the undersides of the shaped rollers and slippers. The ribbon of mortar so formed is thereafter cut to form discrete tiles on the pallets.

In use, the tiles can only be assembled, i.e. laid, on a roof in half-bond relationship, see FIGS. 2 and 3; however, the effect is startlingly attractive in that while the in-line valley portions of the tiles are of uniform thickness the roll portions of the tiles both up and across the roof have a thick-thin, thick-thin appearance.

A considerable saving, up to 15% by weight, results from manufacturing tiles according to this invention while the strength of the tile is evenly distributed over the roof in a most effective way.

Modifications may be made within the scope of the present invention. Also it is envisaged that tiles according to the invention may be made from clay or any other suitable composition.

What is claimed is:

1. A roof tile, comprising:

a raised central portion, a raised interlocking side portion at each side of said tile and a valley portion between each side portion and said central portion, said tile having a front edge surface which extends across the width of said tile and which is visible when positioned in half-bond relationship between adjacent tiles of a roof in use, characterized in that said front edge surface is of a depth which has a relatively thin section coincident with said central portion and relatively thicker sections coincident with said interlocking side portions, said valley portions having first and second widths, said raised central portion having a section extending generally upwardly from a side of said first width to an apex thereof and having a section extending generally downwardly from said apex to a side of said second width, said thin section being coincident with at least a portion of both said section extending generally upwardly and said section extending generally downwardly;

wherein a bottom of both said raised interlocking side portions at an apex of two interlocked raised interlocking side portions of two adjacent tiles is at an elevation substantially higher than an upper surface of said valley portions.

2. A tile according to claim 1, wherein the front edge surface of the tile varies in depth across the width of the tile as between said relatively thin section coincident with said central portion, sections coincident with said valley portions having a depth greater than that of said relatively thin section, and said relatively thicker sections coincident with said interlocking side portions progressively increasing in depth from said valley portions.

3. A tile according to claim 2, wherein the depth of said valley portions is less than a combined depth of the interlocked side portions of mutually sideways adjacent tiles.

4. A tile according to claim 2, wherein the central portion (36) is relatively thin as aforesaid for at least one-third of the length of the tile.

5. A tile according to claim 3, wherein the central portion (36) is relatively thin as aforesaid for at least one-third of the length of the tile.

6. A roof covered with roof tiles according to claim 2 wherein, in use, each horizontal row of tiles is laid in half-bond relationship with adjacent horizontal rows of such tiles and such tiles in half-bond relationship having an overlapped headlap portion and an overlapped tail portion and wherein combined overlapped thicknesses of the tiles in one such row of tiles and the tiles of adjacent rows of tiles at overlapped headlap and tail portions thereof are substantially the same.

7. A roof according to claim 6 wherein the roof has a visual appearance in which a constant thickness is evident at the valley portions of the tiles of each column of tiles on the roof whereas roll portions thereof have a thick-thin, thick-thin appearance both in sideways adjacent columns of such tiles and in each individual column thereof.

8. A roof covered with roof tiles according to claim 3 wherein, in use, each horizontal row of tiles is laid in half-bond relationship with adjacent horizontal rows of such tiles and such tiles in half-bond relationship having an overlapped headlap portion and an overlapped tail portion and wherein combined overlapped thicknesses of the tiles in one such row of tiles and the tiles of adjacent rows of tiles at overlapped headlap and tail portions thereof are substantially the same.

9. A roof according to claim 8 wherein the roof has a visual appearance in which a constant thickness is evident at the valley portions of the tiles of each column of tiles on the roof whereas roll portions thereof have a thick-thin, thick-thin appearance both in sideways adjacent columns of such tiles and in each individual column thereof.

10. A tile according to any one of claim 1 wherein the central portion (36) is relatively thin as aforesaid for at least one-third of the length of the tile.

11. A tile according to claim 10 wherein the central portion (36) is relatively thin as aforesaid for the full length of the tile.

12. A tile according to claim 11 wherein the raised central portion thereof comprises an upper profile generated along the length thereof wherein said apex of said upper profile is configured to be capable of being located below a corresponding apex of a similar profile generated by the interlocked side portions of mutually sideways adjacent tiles in use.

13. A tile according to claim 12 which comprises a bold roll or double Roman profile tile.

14. A roof covered with roof tiles according to claim 1 wherein, in use, each horizontal row of tiles is laid in half-bond relationship with adjacent horizontal rows of such tiles and such tiles in half-bond relationship having an overlapped headlap portion and an overlapped tail portion and wherein combined overlapped thicknesses of the tiles in one such row of tiles and the tiles of adjacent rows of tiles at overlapped headlap and tail portions thereof are substantially the same.

15. A roof according to claim 14 wherein the visual appearance of the roof is one in which a constant thickness is evident at the valley portions of the tiles of each column of tiles on the roof whereas the roll portions thereof have a thick-thin, thick-thin appearance both in sideways adjacent columns of such tiles and in each individual column thereof.

16. The roof tile according to claim 1, wherein said relatively thin section has a generally constant thickness.

17. The roof tile according to claim 16, wherein said raised central portion is generally arcuate.

18. The roof tile according to claim 17, wherein said relatively thin section corresponds to substantially said entire arcuate raised central portion.

19. The roof tile according to claim 17, wherein said valley portions are generally flat.

20. The roof tile according to claim 1, wherein said valley portions are generally flat and said raised central portions are generally arcuate.

21. The roof tile according to claim 1, wherein an upper surface of said raised interlocking side portions both extend to a top edge a distance above said upper surface of said valleys portions that is greater than a distance across each of the first and second widths of the valleys portions, individually, such that the interlock connection between adjacent tiles is at an elevation substantially above the upper surface of said valleys portions.

22. The tile according to claim 1, wherein said raised central portion is generally arcuate, said raised interlocking side portions are generally arcuate, and said valleys portions are generally flat.

23. A roof tile, comprising:

a raised central portion, a raised interlocking side portion at each side of said tile and a valley portion between each side portion and said central portion, each said interlocking side portion having a complementary locking section, said tile having a front edge surface which extends across t h e width of said tile and which is visible when positioned in half-bond relationship between adjacent tiles of a roof in use, characterized in that said front edge surface is of a depth which has a relatively thin section coincident with said central portion and relatively thicker sections coincident with said interlocking side portions, said valley portions having first and second widths, said raised central portion having a section extending generally upwardly from a side of said first width to an apex thereof and having a section extending generally downwardly from said apex to a side of said second width, said thin section being coincident with at least a portion of both said section extending generally upwardly and said section extending generally downwardly;

wherein the front edge surface of the tile varies in depth across the width of the tile as between said relatively thin section coincident with said central portion, sections coincident with said valley portions having a greatest depth, and said relatively thicker sections coincident with said interlocking side portions progressively increasing from said valley section to said locking section, said locking section having an intermediate depth;

wherein the depth of the front edge surface in the valley portions approximates to one-half a combined depths of the front edge surface at the relatively thin section coincident with the central portion and the sections of intermediate depth coincident with the interlocked side portions of mutually sideways adjacent tiles in use.

24. A tile according to claim 23, wherein the central portion (36) is relatively thin as aforesaid for at least one-third of the length of the tile.

25. A roof covered with roof tiles according to claim 23 wherein, in use, each horizontal row of tiles is laid in half-bond relationship with adjacent horizontal rows of such tiles and such tiles in half-bond relationship having an overlapped headlap portion and an overlapped tail portion and wherein combined overlapped thicknesses of the tiles in one such row of tiles and the tiles of adjacent rows of tiles at overlapped headlap and tail portions thereof are substantially the same.

26. A roof according to claim 25 wherein the roof has a visual appearance in which a constant thickness is evident at the valley portions of the tiles of each column of tiles on the roof whereas roll portions thereof have a thick-thin, thick-thin appearance both in sideways adjacent columns of such tiles and in each individual column thereof.

27. A roof tile, comprising:

a raised central portion, a raised interlocking side portion at each side of said tile and a valley portion between each side portion and said central portion, said each interlocking portion having a complementary locking section, said tile having a front edge surface which extends across the width of said tile and which is visible when positioned in half-bond relationship between adjacent tiles of a roof in use, characterized in that said tile, in view of front edge surface, has a depth which has a relatively thin section coincident with said central portion and relatively thicker sections coincident with said interlocking side portions, said valley portions having widths first and second widths, said raised central portion having a section extending generally upwardly from a side of said first widths to an apex thereof and having a section extending generally downwardly to a side of said second width from said apex, said thin section being coincident with at least a portion of both said section extending generally upwardly and said section extending generally downwardly, and said thicker section being progressively increased from said valley section to said complementary locking section;

wherein a bottom of said raised central section at said apex thereof is at an elevational substantially higher than an upper surface of said valley portions.

28. A roof tile, comprising:

a raised central portion, a raised interlocking side portion at each side of said tile and a valley portion between each side portion and said central portion, said tile having a front edge surface which extends across the width of said tile and which is visible when positioned in half-bond relationship between adjacent tiles of a roof in use, characterized in that said front edge surface is of a depth which has a relatively thin section coincident with said central portion and relatively thicker sections coincident with said interlocking side portions, said valley portions having first and second widths, said raised central portion having a section extending generally upwardly from a side of said first width to an apex thereof and having a section extending generally downwardly from said apex to a side of said second width, said thin section being coincident with at least a portion of both said section extending generally upwardly and said section extending generally downwardly;

wherein a bottom of said raised central section at said apex thereof is at an elevation substantially higher than an upper surface of said valley portions; and wherein said elevational distance between the bottom of said raised central section at said apex and said upper surface of said valley portions is a distance greater than a multiple of the thickness of said relatively thin section.

29. A roof tile, comprising:

a raised central portion, a raised interlocking side portion at each side of said tile and a valley portion between each side portion and said central portion, each said interlocking side portion having a complementary locking section, said tile having a front edge surface which extends across the width of said tile and which is visible when positioned in half-bond relationship between adjacent tiles of a roof in use, characterized in that said front edge surface is of a depth which has a relatively thin section coincident with said central portion and relatively thicker sections coincident with said interlocking side portions, said valley portions having first and second widths, said raised central portion having a section extending generally upwardly from a side of said first width to an apex thereof and having a section extending generally downwardly from said apex to a side of said second width, said thin section being coincident with at least a portion of both said section extending generally upwardly and said section extending generally downwardly;

wherein the front edge surface of the tile varies in depth across the width of the tile as between said relatively thin section coincident with said central portion, sections coincident with said valley portions having a greater depth than the depth of said relatively thin section but of less depth than the depth of said interlocking side portions, said interlocking side portions progressively increasing in depth from said valley section to said locking section;

wherein the depth of the front edge surface in the valley portions approximates to one-half a combined depths of the front edge surface at the relatively thin section coincident with the central portion and the sections coincident with the interlocked side portions of mutually sideways adjacent tiles in use.

30. The tile according to claim 29, wherein said raised central portion is generally arcuate, said raised interlocking side portions are generally arcuate, and said valleys portions are generally flat.

* * * * *